United States Patent [19]

Furukawa et al.

[11] 4,444,628

[45] Apr. 24, 1984

[54] PROCESS FOR TREATING AL ALLOY CASTING AND DIE CASTING

[75] Inventors: Shichiro Furukawa, Osaka; Yutaka Nakagishi, Ueno; Shigeru Yamato, Osaka, all of Japan

[73] Assignee: Okuno Chemical Industry Co., Ltd., Osaka, Japan

[21] Appl. No.: 526,025

[22] Filed: Aug. 24, 1983

[30] Foreign Application Priority Data

Aug. 26, 1982 [JP] Japan ..... 57-148745

[51] Int. Cl.[3] ..... C25D 11/16; C25D 11/18

[52] U.S. Cl. ..... 204/29; 204/33; 204/58; 204/35 N

[58] Field of Search ..... 204/33, 29, 58, 35 N

[56] References Cited

U.S. PATENT DOCUMENTS 2,708,655 5/1955 Turer ..... 204/33

4,396,468 8/1983 Walls ..... 204/33

*Primary Examiner*—R. L. Andrews

*Attorney, Agent, or Firm*—Armstrong, Nikaido, Marmelstein & Kubovcik

[57] ABSTRACT

Aluminum alloy castings and aluminum alloy die castings are treated in the process comprising the steps of chemically polishing the castings, processing the chemically polished castings by barreling and/or by blasting and subjecting successively the castings to degreasing, anodic oxidation, dyeing and sealing.

39 Claims, No Drawings

PROCESS FOR TREATING AL ALLOY CASTING AND DIE CASTING

This invention relates to a process for treating an aluminum alloy casting or an aluminum alloy die casting and more particularly to such process in which an anodic oxide layer of uniform thickness is formed on the surface of the casting and the oxide layer is then uniformly dyed.

Aluminum (hereinafter simply referred to as "Al") alloy castings are produced by charging molten metal into a sand mold, metal mold or shell mold, whereas Al alloy die castings are made by forcing molten metal into a metal mold under pressure. Al alloy castings or Al alloy die castings have the compositions as specified in JIS H 5205 and JIS H 5302, respectively and contain far larger amounts of metallic elements such as Si, Mg, Cu, Fe, etc. than rolled Al alloy sheets. While these components serve to improve the castability and the machinability of Al alloys, they cause defects in casting such as wrinkles, cavities, etc. which are likely to impair the appearance of a surface-treated product. Even after chemical polishing, difficulty is entailed in anodic oxidation of these alloy castings. For these reasons, the castings of these Al alloys are usually used without surface treatment except those of alloys having an ability to form an anodic oxide layer or are employed after merely coating the surface thereof, as is the case with the castings of copper-containing silumin-type alloys. The reasons why these alloys involve difficulty in anodic oxidation are presumably as follows.

1. Because of higher contents of Si and the like in the castings of these alloys than those in rolled Al alloy sheets, the behavior of these metallic elements in anodic oxidation becomes irregular at the chilled layer in the upper portion of the casting having a high Si concentration.

2. The castings of these alloys have casting defects such as cavities and nonmetallic inclusions and involve uneven texture problems such as crystals of nonuniform particle sizes and undesirable patterns due to irregular flow of molten metal.

A variety of proposals have been made in an attempt to overcome the difficulties in surface treatment of castings of these alloys, but all remain unsatisfactory. For example, Japanese Examined Patent Publication No. 31744/1979 discloses a method for treating the surface of an Al alloy die casting with a bath predominantly containing hydrofluoric acid or hydrofluoric acid compound. But this method remains to be improved in the following respects:

(a) The method markedly melts Al as well as the other components in the alloy, thereby forming a rough surface on the casting. This means that if the casting is a precision machine part, a problem is posed in respect of dimensional accuracy; (b) When the casting is subjected to anodic oxidation and then dyed, the dye is adsorbed in a greatly reduced amount; (c) An Al die casting of complex shape invariably contains water before immersion in a bath which water greatly varies the water content of the bath. This change appreciably alters the reaction rate, consequently giving an irregular surface roughness to the casting and impairing the dimensional accuracy. Japanese Examined Patent Publication No. 47274/1981 teaches a method in which the casting is heat-treated to render the alloy crystallographically homogeneous. This method, however, can not obviate the difficulties in surface treatment of copper-containing silumin-type die castings or the like.

An object of the present invention is to provide a process for treating the surface of an Al alloy casting or an Al alloy die casting in which anodizing, dyeing and sealing treatments can be conducted without being affected by wrinkles, cavities, micropores, and like defects in the casting.

Another object of the invention is provide a process for treating the surface of an Al alloy casting or Al alloy die casting in which anodizing, dyeing and sealing treatments can be performed without markedly impairing the dimensional accuracy.

A further object of the invention is to provide an Al alloy casting or an Al alloy die casting with the surface satisfactorily dyed.

Other objects and features of the present invention will become apparent from the following description.

This invention provides a process for treating the surface of an Al alloy casting or an Al alloy die casting, the process comprising the steps of chemically polishing the casting with a bath containing phosphoric acid, processing the chemically polished casting by tumbling and/or by blasting and subjecting successively the casting to degreasing, anodic oxidation, dyeing and sealing.

This invention provides another process for treating an Al alloy casting or an Al alloy die casting, the process comprising the steps of chemically polishing the casting with a bath containing phosphoric acid, treating the chemically polished casting with a bath containing at least one of hydrofluoric acid and fluorine compound, processing the treated casting by tumbling and/or by blasting and subjecting successively the casting to degreasing, anodic oxidation, dyeing and sealing.

This invention further provides a process for treating an Al alloy casting or an Al alloy die casting, the process comprising the steps of chemically polishing the casting with a bath containing phosphoric acid, treating the chemically polished casting with a bath containing phosphoric acid, nitric acid, and at least one of hydrofluoric acid and fluorine compound, processing the treated casting by tumbling and/or by blasting and subjecting successively the casting to degreasing, anodic oxidation, dyeing and sealing.

We conducted extensive research to overcome the difficulties heretofore encountered in treating an article of Al alloy casting or Al alloy die casting and found that when degreasing the article in a usual manner, chemically polishing the degreased article with a bath containing phosphoric acid, and processing the chemically polished article by barreling and/or by blasting to adjust the state of the surface thereof, the difficulties are greatly alleviated and the anodic oxidation and dyeing treatment can be facilitated. The present invention has been accomplished based on this novel finding.

The present invention includes the foregoing three processes (hereinafter each referred to as "first process", "second process" and "third process" of the invention, respectively) which will be described below in greater detail. The percentages in the following description are all by weight unless otherwise indicated.

I. FIRST PROCESS OF THE INVENTION (1) An Al alloy casting or an Al alloy die casting is chemically polished with a bath containing phosphoric acid. A phosphoric acid-type bath commonly used in chemically polishing wrought Al sheets is usable for this purpose. The bath usually contains about 40 to about 80% by weight of phosphoric acid and about 2 to about 10% by weight of nitric acid and may optionally have incorporated therein at least one of about 5 to about 30% by weight of sulfuric acid, about 5 to about 15% by weight of acetic acid and about 0.02 to about 0.05% by weight of copper nitrate. Further, at least one of compounds such as urea, acetic acid, guanidine salts and the like may be added to the bath. The treatment is usually conducted at about 90° to about 120° C. for about 5 to about 300 seconds. The chemical polishing is conducted, for example, using baths having the compositions given below under the following conditions.

(i) An Al alloy casting or die casting is chemically polished in a bath consisting of 40 to 80% of $H_3PO_4$ (89%), 2 to 60% of $HNO_3$ and water as the balance at a temperature of about 80° to about 100° C. for about 6 to about 120 seconds and is washed with water. Urea, glacial acetic acid or the like can be incorporated in the bath to prevent the generation of nitrogen oxides.

(ii) An Al alloy cast or die cast is chemically polished in a bath consisting of 40 to 80% of $H_3PO_4$ (specific gravity of 1.697), 2 to 10% of $HNO_3$ (specific gravity of 1.42) and water as the balance at a temperature of about 90° to about 110° C. for about 30 to about 240 seconds and is washed with water. Urea or the like can be added to preclude the formation of nitrogen oxides as in the chemical polishing described above in (i).

(iii) An Al alloy casting or die casting is chemically polished in a bath consisting of 50 to 80% of $H_3PO_4$ (specific gravity of 1.697), 5 to 20% of $HNO_3$ (specific gravity of 1.42) and 3 to 20% of $CH_3COOH$ (specific gravity of 1.06) at a temperature of about 90° to about 110° C. for a suitable period of time and is washed with water. An additive or additives indicated above can be used to prevent the generation of nitrogen oxide.

(iv) An Al alloy cast or die cast is chemically polished in a bath consisting of 70 to 80% of $H_3PO_4$ (specific gravity of 1.697), 3 to 5% of $HNO_3$ (specific gravity of 1.42), 3 to 5% of acetic acid (specific gravity of 1.06), 0.05 to 1 w/v % of copper nitrate and water as the balance at a temperature of about 90° to about 100° C. for about 60 to about 300 seconds and is washed with water. The generation of nitrogen oxide can be prevented in the same manner as above.

(2) The chemically polished article of the Al alloy casting or die casting is processed by barreling and/or by blasting to polish the surface and removing irregularities therefrom.

(i) Tumbling or barreling is conducted by placing in a barrel the chemically polished casting, together with at least one of media of various sizes and shapes such as metal balls, plastics particles, silica particles, synthetic emery particles, etc. and a mixture of compounds such as soap, glycerin, surfactant, etc. and polishing and clearing the surface to adjust the state thereof. The barrels useful in the present invention include a rotation-type barrel, vibration-type barrel, gyration-type barrel, etc. The treatment with a vibration-type barrel using steel balls as medium is advantageous from the viewpoints of productivity, costs, etc.

(ii) Blasting treatment is performed by blowing abrasive particles against the chemically polished casting with a blast of compressed air and with or without water (wet or dry method). Examples of abrasives include metallic abrasives such as cast iron shots, steel shots, steel grits, etc., nonmetallic abrasives such as silica particles, carborundum particles, glass beads, etc. In the present invention, the wet method using glass beads, plastics beads, glass fibers or like nonmetallic abrasives is preferred because the method gives good appearance to the finished surface of the casting and prevents fine abrasives from remaining in cavities or the like in the casting.

(3) After treatment by barreling and/or blasting, the Al alloy casting or die casting is subjected successively to the same degreasing, anodic oxidation, dyeing and sealing treatments as those usually performed for rolled Al sheets. Typical examples of these treatments are given below.

(A) Degreasing

Degreasing treatment is conducted in a bath of relatively low-corrosive type containing at least one of sulfuric acid, nitric acid, phosphoric acid and oxalic acid and/or a surfactant. The bath contains such acid in a concentration of about 5 to about 35% and/or the surfactant in a concentration of about 0.1 to about 1.5%. The treatment is usually carried out at a temperature in the range of room temperature to about 100° C. and the article is immersed in the bath for about 30 to about 400 seconds. For example, the baths of the following compositions are employed under the conditions stated below.

(i) A bath containing 30% of sulfuric acid and 1% of a nonionic surface-active agent at 45° C. for 3 minutes.

(ii) A bath containing 20% of sulfuric acid, 10% of nitric acid and 1% of a nonionic surfactant at 35° C. for 5 minutes.

(iii) A bath containing 20% of phosphoric acid and 1% of a surfactant at 50° C. for 1 minute.

(B) Anodic oxidation

Anodic oxidation is conducted in the usual manner by passing AC, DC, superimposed AC-DC, pulse current or the like through a solution containing at least one of sulfuric acid, oxalic acid and like organic acids. Usually the anodic oxidation is performed by placing the degreased casting in a solution containing about 5 to about 25% of sulfuric acid and, when required, about 0.1 to about 1% of oxalic acid or like organic acid, at a temperature of about 10° to about 30° C. and at a current density of about 1 to about 50 $A/dm^2$ for about 15 to about 120 minutes. For example, solutions of the following compositions are employed under the conditions stated below.

(i) DC is passed through a solution containing 18% of sulfuric acid at 20° to 25° C. and 1 to 1.5 $A/dm^2$ for 30 to 60 minutes.

(ii) DC is passed through a solution containing 20% of sulfuric acid and 0.2% of oxalic acid at 15° C. and 2 $A/dm^2$.

(C) Dyeing

The Al alloy casting or die casting with anodized oxide layer is dyed by using commercially available dyestuffs to be used for dyeing oxidized Al articles. The dyeing is usually conducted in a bath having a dye concentration of about 1 to about 15 g/l at a temperature ranging from room temperature to about 60° C. for about 10 seconds to about 20 minutes. The dyeing conditions are determined depending on the kind of the dye to be used. For example, the dyeing is effected by using:

(i) a solution containing 1% of TAC BLACK-415 (product of HODOGAYA KAGAKU KOGYO K.K., Japan) at ph 5.6 and 50° C. for 10 minutes;

(ii) a solution containing 0.5% of TAC BLUE 502 (product of HODOGAYA KAGAKU KOGYO K.K., Japan) at pH 6.0 and 55° C. for 5 minutes.

(D) Sealing

An aqueous sealing solution containing about 1 to about 10 g/l of nickel acetate is usually used to seal the dyed surface of the casting. Additives such as a surfactant (1 to 10 g/l) and a pH buffer (1 to 3 g/l) can be added to the bath in addition to the nickel acetate. Sealing is conducted at about 80° to about 100° C. for about 5 to about 30 minutes. For example, a sealing solution containing 0.7% of TOP SEAL DX-200 (trade mark, product of Okuno Chemical Industry Co., Ltd., Japan) is used at 95° C. for 10 minutes at a pH of 5.6.

II. SECOND PROCESS OF THE INVENTION (1) Chemical polishing of an Al alloy casting or die casting with a bath containing phosphoric acid is conducted in the same manner as in the first process of the invention.

(2) The chemically polished Al alloy casting or die casting is treated with a bath containing hydrofluoric acid and/or fluorine compound. Examples of useful fluorine compounds are NaF, KF, $NH_4F$, $NH_4HF_2$, $KHF_2$, etc. which are commercially advantageous in solubility, costs, etc. Also usable as fluorine compounds are silicofluorides, metal fluorides, etc. which are soluble in a strongly acidic solution. Hydrofluoric acid and/or fluorine compound are used preferably in a fluorine ion concentration of about 1 to about 20%. Treatment temperatures and time vary with the fluorine ion concentration, etc. and usually range from about 0° to about 40° C. and from about 5 to about 180 seconds, respectively. When required, about 3 to about 40% of nitric acid and/or about 10 to about 30% of sulfuric acid are incorporated in the bath containing hydrofluoric acid and/or fluorine compound.

Polyvinyl pyrrolidone or like water-soluble high molecular weight compounds, surfactant, urea, sulfamic acid salts, etc. may be added to the hydrofluoric acid-type bath to control the reaction, adjust the reaction rate and inhibit the generation of NOX (when nitric acid is used). The treatment is carried out, for example, using the following baths containing hydrofluoric acid and/or fluorine compound under conditions given below;

(i) a bath containing 3 to 10% of 55% hydrofluoric acid, 5 to 20% of 62% nitric acid, and water as the balance at 10° to 40° C. for 20 to 180 seconds;

(ii) a bath containing 10 to 30% of 55% hydrofluoric acid and 70 to 90% of fuming nitric acid at 10° to 30° C. for 3 to 60 seconds;

(iii) a bath containing 50 to 75% of 50% acidic ammonium fluoride, 15 to 30% of nitric acid, 1 to 15% of sulfuric acid and water as the balance at 10° to 30° C. for 10 to 60 seconds.

(3) After treatment with a bath containing hydrofluoric acid and/or fluorine compound, the Al alloy casting or die casting is treated by barreling and/or by blasting in the same manner as in the first process of the invention.

(4) The casting thus treated is successively subjected to degreasing, anodic oxidation, dyeing and sealing in the same manner as in the first process of the invention.

III. THIRD PROCESS OF THE INVENTION (1) Chemical polishing of an Al alloy casting or die casting with a bath containing phosphoric acid is performed in the same manner as in the first process of the invention.

(2) The chemically polished casting is treated with a bath containing at least one of hydrofluoric acid and fluorine compounds, phosphoric acid and nitric acid. The compounds of the bath will be described below in detail.

(i) Hydrofluoric acid and fluorine compounds can be used singly or in a mixture of at least two of them. The same examples of useful fluorine compounds as used in the second process of the invention are usable in this process. Hydrofluoric acid and/or fluorine compound are used preferably in an amount to provide a fluorine ion concentration of about 2 to about 15%. With their contents of less than 2%, unsatisfactory effects of treatment are produced, thereby decreasing the reaction rate, and leading to insufficient removal of smuts from the surface of the casting which results in poor appearance of the product. The use thereof in excess of 15% generates NOX in greatly increased amounts, consequently deteriorating the operation conditions.

(ii) The amount of phosphoric acid is preferably about 35 to about 75% of the bath. When phosphoric acid is used in an amount of less than 35%, insufficient removal of smuts results and NOX is generated in higher amounts. Its content of more than 75% leads to decrease in reaction rate.

(iii) The amount of nitric acid is preferably about 2 to about 25% of the bath. With its content of less than 2%, the reaction rate is reduced and removal of smuts is insufficient with a poor appearance of the product. Its content of more than 25% generates increased amounts of NOX and impairs the operation conditions.

To the bath can be added additives commonly used for the bath in chemically polishing rolled Al alloy sheets. These additives are effective in controlling the reaction, reducing the amount of NOX generated and adjusting the reaction rate and thus can improve the effects of the bath. Useful additives include polyvinyl pyrrolidone and like water-soluble high molecular weight substances, surfactants, urea, sulfamic acid salts, acetic acid, acetates, guanidine salts, carbamates, etc.

The treatment with the foregoing bath is carried out as follows. An Al alloy casting or Al alloy die casting is immersed in an aqueous solution containing at least one of hydrofluoric acid and fluorine compound, phosphoric acid, and nitric acid at a temperature of less than 40° C., preferably about 15° to about 30° C. for about 10 to about 180 seconds to treat the surface of the casting.

(3) The casting thus treated is subjected to tumbling and/or blasting in the same manner as in the first process of the invention.

(4) The casting thus treated is subjected to degreasing, anodic oxidation, dyeing and sealing in the same manner as in the first process of the invention.

In the processes of the invention, degreasing may be conducted prior to the chemical polishing of the casting when required. When an Al alloy casting or die casting is produced in a metal mold, some of releasing agents such as oils and silicone oils may be firmly adhered to the surface of the casting by heating. In treating the casting with the releasing agent partly adhered to the surface thereof, degreasing treatment is necessary to prevent dyeing irregularities which otherwise would be likely to occur in such case. Usable as baths for degreasing are those commonly used in degreasing rolled Al sheet. Since an alkaline degreasing bath is capable of dissolving the Al alloy substrate in a high degree, consideration should be taken to determine suitable treatment conditions. The surface of the casting is preferably degreased with an aqueous solution of an acid such as sulfuric acid, nitric acid or organic acid or a mixture of these acids and/or an aqueous solution of a surfactant and washed with water.

The processes of the present invention can achieve the following remarkable results.

(a) Substantially no portion of Al is dissolved in chemical polishing treatment, and thus there occurs no surface roughness which results in the reduction in dimensional accuracy.

(b) It is possible to shorten the time for treatment with hydrofluoric acid and/or fluorine compound in the second process of the invention. The reduced time for the treatment lessens the possibility of a rough surface being formed, thereby obviating the possible reduction in dimensional accuracy.

(c) The processes of the invention can provide a product which is substantially free from the surface defects common in conventional products, such as cavities, wrinkles, etc. and the processes can uniformly dye the surface of the casting so that good appearance is given to the product.

(d) The present processes produce articles with the dye absorbed in large amount and substantially without poorly dyed portion.

The present invention will be described below in more detail with reference to the following examples and comparison examples.

The properties and defects of the products obtained in the examples and comparison examples were determined by the following methods.

1. Amount of adsorbed dye

After completion of dyeing and sealing treatments, the Al alloy die castings (JIS H 5302, ADC 12) weighing 38.95 to 39.45 g and having a surface area of 128.5 $cm^2$ were immersed in a 10% aqueous solution of NaOH to dissolve out the oxide film formed on the surface, whereby the absorbance of the dye adsorbed on the film was determined and the amount of the adsorbed dye was obtained.

2. Dimensional accuracy

Treated die cates (JIS H 5302, ADC 12) which weighed 38.95 to 39.45 g and which had a surface area of 1.28.5 $cm^2$ were treated with a specified bath. Thereafter the reduced weight of the product was obtained and the thickness ($\mu$m) of the dissolved-out portion was calculated based on the specific gravity value of ADC 12.

3. Dyeing defectiveness

Die castings (JIS H 5302, ADC 12) which were identical in the weight and surface area with those used in the above tests were treated with a specified bath and dyed. The surface area of the undyed portions was expressed in terms of percentage. A mean value of 10 samples are given.

4. Formation of wrinkles, cavities and like defects.

Ten samples of die casts (JIS H 5302, ADC 12) which were identical in size to those used in the above tests were treated with a specified bath. The number of samples with surface defects such as wrinkles, cavities, etc. was expressed in terms of percentage.

5. Dyeing effect

Die casts (JIS H 5302, ADC 12) which were identical with those used as above but subjected to all treatments ending in sealing were observed under the unaided eye to assess the dyeing effect and ranked as A, B, C or D in accordance with the following criterion.

A . . . Uniformly dyed and completely free from irregularity in color depth due to uneven dyeing as a whole.

B . . . Almost uniformly dyed and substantially free from irregurality in color depth due to uneven dyeing as a whole.

C . . . Dyed with slight unevenness and irregular in color depth due to non-uniform dyeing as a whole.

D . . . Unevenly dyed and markedly irregular in color depth due to non-uniform dyeing as a whole.

6. Surface gloss

Die castings (JIS H 5302, ADC 12) treated with a specific bath were observed under the unaided eye to assess the degree of surface gloss and ranked as A, B, C or D in accordance with the following criterion.

A: Excellent
B: Good
C: Fair
D: Poor

Example 1

(i) An Al alloy die cast was immersed in a 20% sulfuric acid solution at 50° C. for 4 minutes, and washed with water to degrease the surface thereof (The degreasing treatment was conducted in the same manner in all the following examples and comparison examples).

(ii) The die casting with the degreased surface was immersed in bath consisting of 82.5% of 85% phosphoric acid, 7.0% of 2% nitric acid, 0.5% of $Cu(NO_3)_2$ and water as the balance at 100° C. for 1 minute to chemically polish the surface thereof.

(iii) The chemically polished article was further polished for 10 minutes by barreling polisher (Model CL-50, product of Shikishmia Chipton K. K., Japan).

(iv) The mechanically polished casting was degreased again in the same manner as in (i).

(v) The casting was immersed in a bath containing 180 g/l of sulfuric acid to conduct anodic oxidation at a temperature of 23±1° C., a voltage of 18 V and a current density of 1.5 A/$dm^2$ for 50 minutes.

(vi) The die casting with oxide layer formed was immersed in a bath containing 10 g/l of a dye (A) (TAC BLACK 419, product of Hodogaya Kagaku Kogyo K. K., Japan) or a bath containing 10 g/l of a dye (B) (TAC BLUE 502, product of Hodogaya Kagaku Kogyo K. K., Japan) or a bath containing 5 g/l of a dye (C) (TAG ORANGE 302, product of Hodogaya Kagaku Kogyo K. K., Japan) at 60° C. for 10 minutes to dye the surface thereof.

(vii) The casting with the surface thus dyed was immersed in a bath containing 7 g/l of a nickel acetate-type sealing agent (TOP SEAL DX-200, product of Okuno Chemical Industry Co., Ltd., Japan) at 95° C. for 10 minutes.

The die cast thus treated was tested for properties and defects which were assessed in the manner as stated above with the results shown in Table 1 given below.

Example 2

(i) A die cast (JIS H 5302, ADC 12) was degreased in the same manner as in Example 1.

(ii) The degreased article was chemically polished in the same manner as in Example 1.

(iii) The chemically polished article was immersed in a bath containing 3% of volume of nitric acid (62%) and 1% by volume of hydrofluoric acid (48%) at 20° C. for 30 seconds.

(iv) The article was polished by tumbling in the same manner as in Example 1.

(v) The article thus mechanically polished was subjected successively to degreasing, anodic oxidation, dyeing and sealing in the same manner as in Example 1.

The properties and defects of the product thus treated are shown in Table 1 below.

COMPARISON EXAMPLE 1

(i) A die cast (JIS H 5302, ADC 12) was degreased in the same manner as in Example 1.

(ii) The die cast with the surface thus degreased was immersed in a bath consisting of 60% of 50% acidic ammonium fluoride, 21% of nitric acid, 10% of sulfuric acid and water as the balance at 30° C. for 1 minute.

(iii) The casting thus treated was successively subjected in the same manner as in Example 1 to tumbling, degreasing, anodic oxidation, dyeing and sealing.

The properties and defects of the surface thereof were assessed with the results shown in Table 1.

COMPARISON EXAMPLE 2

A die casting (JIS H 5302, ADC 12) was treated in the same manner as in Comparison Example 1 with the exception of using a bath consisting of 30% of 50% acidic ammonium fluoride, 21% of nitric acid, 10% of sulfuric acid and water as the balance in place of the bath used in Comparison Example 1.

Table 1 below shows the properties and defects of the product.

TABLE 1

| | No. | Dye | Amount of adsorbed dye (mg/dm$^2$) | Dimentional accuracy (thickness of dissolved-out portion, μm) | Dyeing defectiveness (%) | Formation of defects (%) | Dyeing effect | Surface gloss |
|---|---|---|---|---|---|---|---|---|
| Ex. 1 | 1 | A | 26.3 | 11.2 | 10 | 10 | A | A |
| | 2 | B | 20.2 | 12.3 | 0 | 20 | A | A |
| | 3 | C | 21.3 | 11.9 | 10 | 20 | A | A |
| Ex. 2 | 1 | A | 27.1 | 13.5 | 0 | 10 | A | A |
| | 2 | B | 21.2 | 12.9 | 10 | 10 | A | A |
| | 3 | C | 20.3 | 13.2 | 0 | 20 | A | A |
| Comp. Ex. 1 | 1 | A | 10.4 | 36.8 | 50 | 60 | B | A |
| | 2 | B | 9.6 | 35.1 | 50 | 60 | C | B |
| | 3 | C | 9.2 | 37.2 | 40 | 50 | C | B |
| Comp. Ex. 2 | 1 | A | 10.9 | 30.1 | 40 | 50 | C | A |
| | 2 | B | 8.8 | 28.3 | 50 | 50 | C | A |
| | 3 | C | 8.6 | 27.9 | 50 | 60 | C | B |

EXAMPLE 3

A casting (JIS H 5302, ADC 12) was surface-treated in the same manner as in Example 1 with the exception of polishing the article by blasting. The blasting was conducted by blowing water against the surface of the article through a nozzle at a pressure of 4 kg/cm$^2$ which water contained 5 g/l of an anti-corrosive agent and had 150-mesh glass beads suspended therein. Table 2 below shows the results.

EXAMPLE 4

A casting (JIS H 5302, ADC 12) was surface-treated in the same manner as in Example 2 with the exception of polishing the article by blasting. The blasting was conducted in the same manner as in Example 3. Table 2 below shows the results.

TABLE 2

| | No. | Dye | Amount of adsorbed dye (mg/dm$^2$) | Dimentional accuracy (thickness of dissolved-out portion, μm) | Dyeing defectiveness (%) | Formation of defects (%) | Dyeing effect | Surface gloss |
|---|---|---|---|---|---|---|---|---|
| Ex. 3 | 1 | A | 29.3 | 13.1 | 0 | 0 | A | A |
| | 2 | B | 20.2 | 12.4 | 0 | 0 | A | A |
| | 3 | C | 21.3 | 11.9 | 10 | 0 | A | A |
| Ex. 4 | 1 | A | 28.4 | 30.2 | 0 | 0 | A | A |
| | 2 | B | 21.6 | 31.4 | 0 | 0 | A | A |
| | 3 | C | 20.9 | 31.6 | 10 | 10 | A | A |

EXAMPLE 5

Al alloy castings (JIS H 5205, AC4B and AC8C) and Al alloy die castings (JIS H 5302, ADC 3 and ADC 12) were immersed in a bath containing 20% of sulfuric acid and 1% of a nonionic surfactant at 40° C. for 3 minutes to degrease the castings. Thereafter the castings were further immersed in a bath consisting of 65% of phosphoric acid, 10% of acidic ammonium fluoride, 10% of nitric acid and water as the balance of 30° C. for 90 seconds. The castings were surface-treated by tumbling or by blasting in the same manner as in Example 1 or 3 and were immersed in a a 20% solution of sulfuric acid to perform anodic oxidation by passing current through the solution at a temperature of 23° C., voltage of 16 to 19 V and current density of 1 to 2 A/dm$^2$ for 40 minutes. Thereafter the castings were immersed in one of baths (A) to (D) given below to conduct dyeing treatment at 60° C. for 10 minutes. Then they were immersed in a bath containing 1% of nickel acetate at 95° C. for 10 minutes to seal the surface of each article. The results are indicated in Table 3 below in which the products thus treated are shown as Nos. 1 to 6 and the products pretreated in the same manner as in Comparison Examples 1 to 4 are indicated as Nos. 7 to 14.

(I) Dyeing bath (A) containing 10 g/l of TAC BLACK 419 (trade mark of a dye produced by Hodogaya Kagaku Kogyo K. K., Japan)

(II) Dyeing bath (B) containing 10 g/l of TAC BLUE 502 (trade mark of a dye produced by Hodogaya Kagaku Kogyo K. K., Japan)

(III) Dyeing bath (C) containing 5 g/l of TAC ORANGE 302 (trade mark of a dye produced by Hodogaya Kagaku Kogyo K. K., Japan)

(IV) Dyeing bath (D) containing 10 g/l of TAC BLACK 415 (trade mark of a dye produced by Hodogaya Kagaku Kogyo K. K., Japan)

TABLE 3

| No. | Al alloy | Pretreatment | Polishing | Dyeing bath | Amount of adsorbed dye ($mg/dm^2$) | Dyeing effect |
|---|---|---|---|---|---|---|
| 1 | AC4B | This invention | Blasting | A | 26.9 | A |
| 2 | AC8C | This invention | Tumbling | B | 21.2 | A |
| 3 | ADC3 | This invention | Blasting | C | 22.6 | A |
| 4 | ADC12 | This invention | Tumbling | D | 27.3 | A |
| 5 | AC8C | This invention | Blasting | A | 27.9 | A |
| 6 | ADC12 | This invention | Tumbling | C | 22.8 | A |
| 7 | AC4B | Comp. Ex. 1 | Blasting | A | 7.8 | D |
| 8 | AC8C | Comp. Ex. 2 | Blasting | B | 4.9 | D |
| 9 | ADC3 | Comp. Ex. 3 | Blasting | C | 5.3 | D |
| 10 | ADC12 | Comp. Ex. 4 | Blasting | D | 8.2 | D |
| 11 | AC4B | Comp. Ex. 1 | Tumbling | D | 8.1 | C |
| 12 | AC8C | Comp. Ex. 2 | Tumbling | A | 8.0 | C |
| 13 | ADC3 | Comp. Ex. 3 | Tumbling | B | 6.4 | D |
| 14 | ADC12 | Comp. Ex. 4 | Tumbling | C | 5.8 | D |

We claim:

1. A process for treating an aluminum alloy casting or an aluminum alloy die casting, the process comprising the steps of chemically polishing the casting with a bath containing phosphoric acid, processing the chemically polished casting by tumbling and/or by blasting and subjecting successively the casting to degreasing, anodic oxidation, dyeing and sealing.

2. A process as defined in claim 1 wherein the chemical polishing is conducted in a bath containing about 40 to about 80% by weight of phosphoric acid and about 2 to about 10% by weight of nitric acid.

3. A process as defined in claim 1 or 2 wherein the chemical polishing bath further contains at least one of about 5 to about 30% by weight of sulfuric acid, about 5 to about 15% by weight of acetic acid and about 0.02 to about 0.05% by weight of copper nitrate.

4. A process as defined in one of claims 1 or 2 wherein the chemical polishing is carried out at a temperature of about 90° to about 120° C. for about 5 to about 300 seconds.

5. A process as defined in claim 1 wherein the degreasing is performed in a bath containing at least one of sulfuric acid, nitric acid, phosphoric acid and oxalic acid in a concentration of about 5 to about 35% by weight and/or a surfactant in a concentration of about 0.1 to about 1.5% by weight.

6. A process as defined in claim 1 or 2 wherein the degreasing is carried out at a temperature in the range of room temperature to about 100° C. for about 30 to about 400 seconds.

7. A process as defined in claim 1 wherein the anodic oxidation is conducted in a solution containing at least one of sulfuric acid, oxalix acid and like organic acids.

8. A process as defined in claim 7 wherein the solution contains about 5 to about 25% by weight of sulfuric acid and/or about 0.1 to about 1% by weight of oxalic acid.

9. A process as defined in one of claims 1, 7 or 8 wherein the anodic oxidation is conducted at a temperature of about 10° to about 30° C. and at a current density of about 1 to about 50 $A/dm^2$ for about 15 to 120 minutes.

10. A process as defined in claim 1 wherein the dyeing is carried out in a bath having a dye concentration of about 1 to about 15 g/l at a temperature ranging from room temperature to about 60° C. for about 10 seconds to about 20 minutes.

11. A process as defined in claim 1 wherein the sealing is effected in a solution containing about 1 to about 10 g/l of nickel acetate.

12. A process for treating an aluminum alloy casting or an aluminum alloy die casting, the process comprising the steps of chemically polishing the casting with a bath containing phosphoric acid, treating the chemically polished casting with a bath containing at least one of hydrofluoric acid and fluorine compounds, processing the treated casting by tumbling and/or by blasting and subjecting successively the casting to degreasing, anodic oxidation, dyeing and sealing.

13. A process as defined in claim 12 wherein the chemical polishing is conducted in a bath containing about 40 to about 80% by weight of phosphoric acid and about 2 to about 10% by weight of nitric acid.

14. A process as defined in claim 12 or 13 wherein the chemical polishing bath further contains at least one of about 5 to about 30% by weight of sulfuric acid, about 5 to 15% by weight of acetic acid and about 0.02 to about 0.05% by weight of copper nitrate.

15. A process as defined in claim 12 to 13 wherein the chemical polishing is carried out at a temperature of about 90 to about 120% for about 5 to about 300 seconds.

16. A process as defined in claim 12 wherein the bath containing hydrofluoric acid and/or fluorine compound has a fluorine ion concentration of about 1 to about 20%.

17. A process as defined in claim 12 or 16 wherein the bath further contains about 3 to about 40% of nitric acid and/or about 10 to about 30% of sulfuric acid.

18. A process as defined in claim 12 or 16 wherein the treatment of the chemically polished casting with the fluorine ion-containing bath is conducted at a temperature of about 0° to about 40° C. and for about 5 to about 180 seconds.

19. A process as defined in claim 12 wherein the degreasing is performed in a bath containing at least one of sulfuric acid, nitric acid, phosphoric acid and oxalic acid in a concentration of about 5 to about 35% by weight and/or a surfactant in a concentration of about 0.1 to about 1.5% by weight.

20. A process as defined in claim 12 or 19 wherein the degreasing is carried out at a temperature in the range of room temperature to about 100° C. for about 30 to about 400 seconds.

21. A process as defined in claim 12 wherein the anodic oxidation is conducted in a solution containing at least one of sulfuric acid, oxalic acid and like organic acids.

22. A process as defined in claim 21 wherein the solution contains about 5 to about 25% by weight of sulfuric acid and/or about 0.1 to about 1% by weight of oxalic acid.

23. A process as defined in one of claims 12, 21 and 22 wherein the anodic oxidation is conducted at a temperature of about 10° to about 30° C. and at a current density of about 1 to about 50 $A/dm^2$ for about 15 to 120 minutes.

24. A process as defined in claim 12 wherein the dyeing is carried out in a bath having a dye concentration of about 1 to about 15 g/l at a temperature ranging from room temperature to about 60° C. for about 10 seconds to about 20 minutes.

25. A process as defined in claim 12 wherein the sealing is effected in a solution containing about 1 to about 10 g/l of nickel acetate.

26. A process for treating an aluminum alloy casting or an aluminum alloy die casting, the process comprising the steps of chemically polishing the casting with a bath containing phosphoric acid, treating the chemically polished casting with a bath containing phosphoric acid, nitric acid, and at least one of hydrofluoric acid and fluorine compounds, processing the treated casting by tumbling and/or by blasting and subjecting successively the casting to degreasing, anodic oxidation, dyeing and sealing.

27. A process as defined in claim 26 wherein the chemical polishing is conducted in a bath containing about 40 to about 80% by weight of phosphoric acid and about 2 to about 10% by weight of nitric acid.

28. A process as defined in claim 26 or 27 wherein the chemical polishing bath further contains at least one of about 5 to about 30% by weight of sulfuric acid, about 5 to 15% by weight of acetic acid and about 0.02 to about 0.05% by weight of copper nitrate.

29. A process as defined in claim 26 or 27 wherein the chemical polishing is carried out at a temperature of about 90 to about 120% for about 5 to about 300 seconds.

30. A process as defined in claim 26 wherein the bath for treating the chemically polished casting contains fluorine ion in a concentration of about 2 to about 15%, phosphoric acid in a concentration of about 35 to about 75% and nitric acid in a concentration of about 2 to about 25%.

31. A process as defined in claim 26 wherein the treating of chemically polished casting is carried out at a temperature less than 40° C. for about 10 to about 180 seconds.

32. A process as defined in claim 31 wherein the treating is carried out at a temperature between about 15° to about 30° C.

33. A process as defined in claim 26 wherein the degreasing is performed in a bath containing at least one of sulfuric acid, nitric acid, phosphoric acid and oxalic acid in a concentration of about 5 to about 35% by weight and/or a surfactant in a concentration of about 0.1 to about 1.5% by weight.

34. A process as defined in one of claims 26 and 33 wherein the degreasing is carried out at a temperature in the range of room temperature to about 100° C. for about 30 to about 400 seconds.

35. A process as defined in claim 26 wherein the anodic oxidation is conducted in a solution containing at least one of sulfuric acid, oxalic acid and like organic acids.

36. A process as defined in claim 35 wherein the solution contains about 5 to about 25% by weight of sulfuric acid and/or about 0.1 to about 1% by weight of oxalic acid.

37. A process as defined in one of claims 26, 35 and 36 wherein the anodic oxidation is conducted at a temperature of about 10° to about 30° C. and at a current density of about 1 to about 50 $A/dm^2$ for about 15 to 120 minutes.

38. A process as defined in claim 26 wherein the dyeing is carried out in a bath having a dye concentration of about 1 to about 15 g/l at a temperature ranging from room temperature to about 60° C. for about 10 seconds to about 20 minutes.

39. A process as defined in claim 26 wherein the sealing is effected in a solution containing about 1 to about 10 g/l of nickel acetate.

* * * * *